US007367856B2

(12) United States Patent
Takahashi et al.

(10) Patent No.: US 7,367,856 B2
(45) Date of Patent: May 6, 2008

(54) PERSONAL WATERCRAFT

(75) Inventors: Keiji Takahashi, Akashi (JP); Toshio Araki, Kakogawa (JP); Atsufumi Ozaki, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/807,772

(22) Filed: May 29, 2007

(65) Prior Publication Data

US 2008/0003895 A1 Jan. 3, 2008

(30) Foreign Application Priority Data

May 29, 2006 (JP) ..... 2006-147657

(51) Int. Cl.
*B63B 35/73* (2006.01)

(52) U.S. Cl. ..... 440/88 A; 440/88 HE

(58) Field of Classification Search ..... 440/88 A, 440/88 HE, 38
See application file for complete search history.

(56) References Cited

U.S. PATENT DOCUMENTS 6,634,420 B2 * 10/2003 Gokan et al. ..... 165/157
7,094,118 B1 * 8/2006 Phillips et al. ..... 440/88 HE

FOREIGN PATENT DOCUMENTS

JP 2003-026092 1/2003

* cited by examiner

*Primary Examiner*—Ed Swinehart
(74) *Attorney, Agent, or Firm*—Alleman Hall McCoy Russell & Tuttle LLP

(57) ABSTRACT

A personal watercraft with a supercharging device and an intercooler is disclosed. The personal watercraft may include an engine, a water jet pump, a propeller shaft to transmit an output power of the engine to the water jet pump, and a bearing case configured to support a front portion of the propeller shaft. The personal watercraft may further include a supercharging device configured to pressurize air taken in from outside and supplied to the engine, an intercooler configured to cool the air pressurized and compressed by the supercharging device, and a pump room which is formed on a bottom surface of a rear end portion of the body and is configured to accommodate the water jet pump therein. The intercooler may be positioned forward of the pump room and behind the engine and may be mounted to an upper surface of the bearing case.

4 Claims, 8 Drawing Sheets

PERSONAL WATERCRAFT

FIELD OF THE INVENTION

The present invention relates to a water-jet propulsion personal watercraft and, particularly to a personal watercraft equipped with a supercharging device and an intercooler.

BACKGROUND OF THE INVENTION

Some personal watercraft are equipped with an engine including a supercharging device such as a turbocharger or a supercharger.

Since the supercharging device is configured to compress air taken in from outside and supply the compressed air to a throttle device such as a throttle body, it generates a compression heat. If the air to be mixed with a fuel has a high temperature, then density of the air decreases, degrading engine performance. Accordingly, in order to cool the high-temperature air, an intercooler is disposed in close proximity to and downstream of the supercharging device.

However, if the intercooler is mounted in a limited internal space of a body of the watercraft, its size cannot be increased. Also, since an internal space of the body of the watercraft which is suitable in size to accommodate the intercooler is distant from a water jet pump, lengthy piping for the intercooler is needed, reducing cooling efficiency of the intercooler.

SUMMARY OF THE INVENTION

The present invention addresses the above described conditions, and an object of the present invention is to provide an engine unit for a personal watercraft which is provided with a shorter piping for an intercooler to improve a cooling efficiency of the intercooler, and a personal watercraft comprising the engine unit.

According to the present invention, there is provided a personal watercraft comprising an engine; a water jet pump configured to be driven by the engine to propel a body of the watercraft; a propeller shaft configured to couple a rear end portion of a crankshaft of the engine to a pump shaft of the water jet pump to transmit an output power of the engine to the water jet pump; a bearing case configured to support a front portion of the propeller shaft such that the propeller shaft is rotatable; a supercharging device configured to pressurize air taken in from outside and supplied to the engine; an intercooler configured to cool the air pressurized and compressed by the supercharging device; and a pump room which is formed on a bottom surface of a rear end portion of the body and is configured to accommodate the water jet pump therein; wherein the intercooler is positioned forward of the pump room and behind the engine and is mounted to an upper surface of the bearing case.

In such a construction, since the intercooler is positioned in close proximity to the water jet pump, a pipe for coupling them can be made short, increasing cooling efficiency.

The intercooler may have an open cooling system configured to take in water pressurized inside the water jet pump for use as cooling water and to discharge the cooling water that has cooled the intercooler outside the body of the watercraft. In this case, the intercooler may have a cooling water passage independent of a cooling water passage of the engine. In this construction, since the cooling system of the intercooler does not depend on piping design of a cooling system of the engine, cooling efficiency can be increased.

The bearing case may be provided inside the body such that the bearing case is located forward of and adjacent the pump room and mounted on an upper region of a water passage through which water taken in from outside is fed to an inlet of the water jet pump.

The personal watercraft may further comprise a pair of first and second water mufflers which are arranged on right and left sides of the bearing case and are positioned so that a front end of the second water muffler is located rearward relative to a front end of the first water muffler in a longitudinal direction of the body, the first and second water mufflers being coupled to each other at rear portions thereof by an exhaust pipe. In this case, a front end portion of the intercooler may be disposed in a forward space of the second water muffler. In such a construction, the forward space of the water muffler located rearward can be efficiently utilized, and interference between a rear portion of the intercooler and the exhaust pipe coupling the pair of water mufflers can be easily avoided.

The above and further objects and features of the invention will more fully be apparent from the following detailed description with accompanying drawings.

DETAILED DESCRIPTION OF THE INVENTION

Hereinafter, a personal watercraft according to an embodiment of the present invention will be described with reference to the accompanying drawings. Hereinbelow, the directions are referenced from a rider riding in a personal watercraft of FIG. 1 except for cases specifically illustrated.

Figure 1:
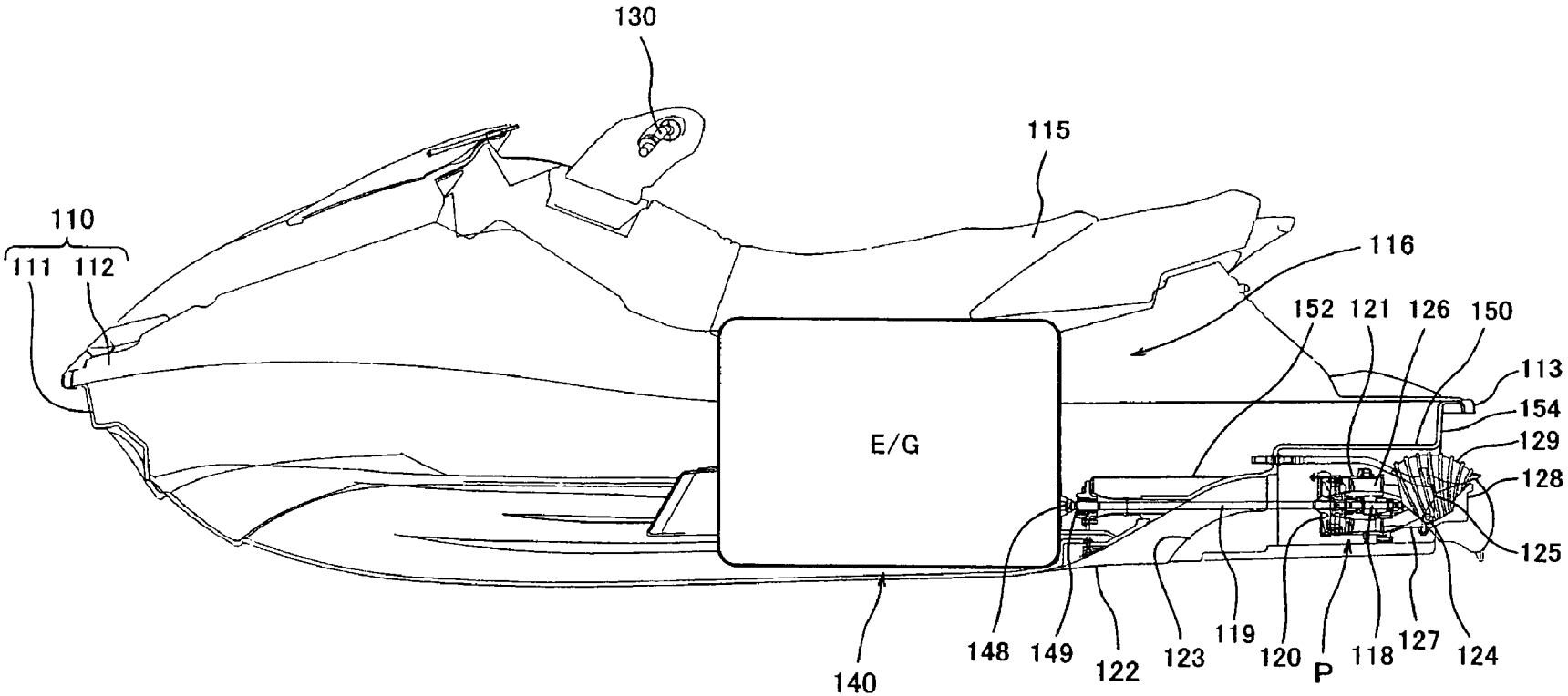
FIG. 1 is a left side view of an entire personal watercraft according to an embodiment of the present invention.
Figure 2:
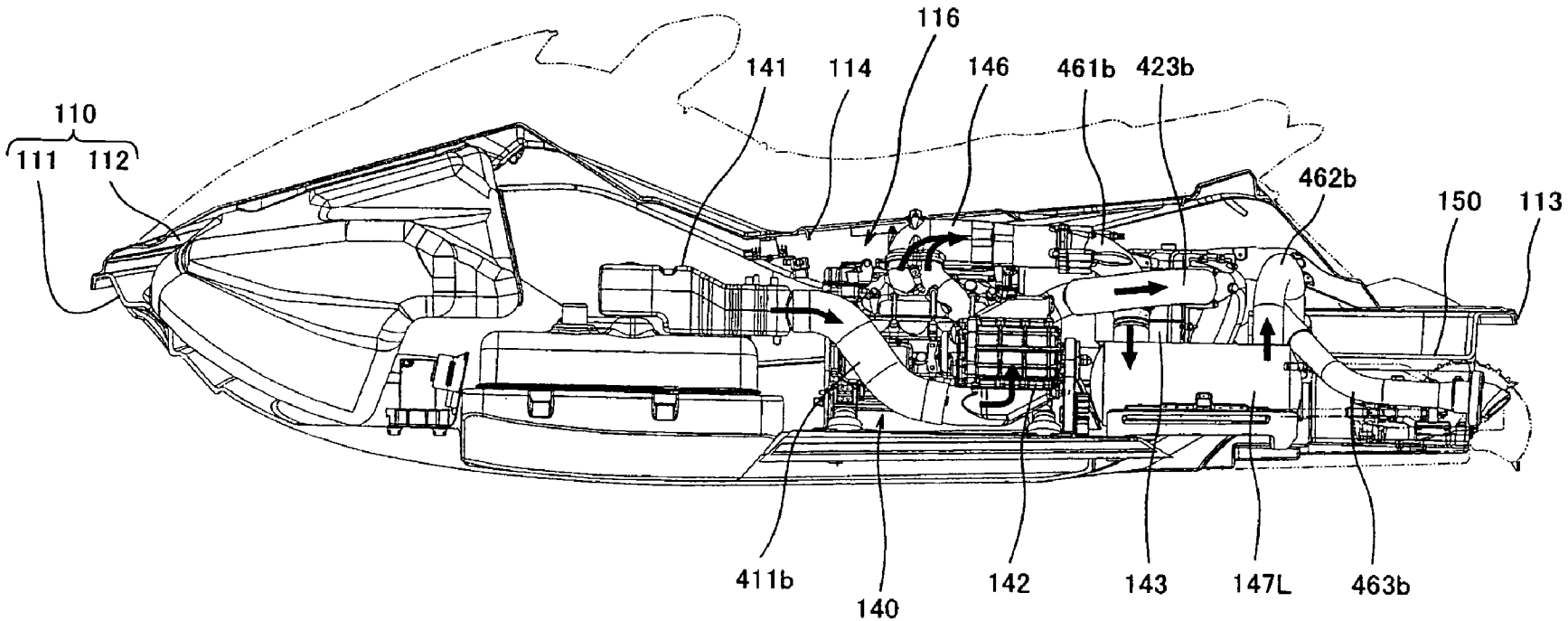
FIG. 2 is a side view of an air intake system and an air exhausting system of an engine of the personal watercraft of FIG. 1, showing a hull and a deck in a cross-section.

Turning now to FIGS. 1, and 2, a body 110 of the watercraft includes a hull 111 and a deck 112 covering the hull 111 from above. A line at which the hull 111 and the deck 112 are connected over the entire perimeter thereof is called a gunnel line 113.

As shown in FIG. 2, a deck opening 114, which has a substantially rectangular shape as seen from above is formed at a substantially center section of the deck 112 in an upper region of the body 110 so as to extend in a longitudinal direction of the body 110. The opening 114 is covered with a straddle seat 115 (FIG. 1) extending in the longitudinal direction. An engine room 116 is provided in a space defined by the hull 111 and the deck 113 below the seat 115 (FIG.

1). An engine 140 is mounted within the engine room 116 and is configured to drive the watercraft.

As shown in FIG. 1, a crankshaft 148 of the engine 140 extends rearward along the longitudinal direction of the body 110. A rear end portion of the crankshaft 148 is rotatably integrally coupled, via a propeller shaft 119, to a pump shaft 118 of a water jet pump P accommodated in a pump room 150 described later provided at a rear portion of the hull 111. An impeller 120 is attached on the pump shaft 118 of the water jet pump P. The impeller 120 is covered with a cylindrical pump casing 121 on the outer periphery thereof.

A water intake 122 is provided on a bottom surface of the hull 111. Water outside the watercraft is sucked from the water intake 122 and is fed to the water jet pump P through a water passage 123. The water jet pump P pressurizes and accelerates the water by the impeller 120. The water is ejected through a pump nozzle 127 having a water cross-sectional area reduced rearward and from an outlet port 125 provided at a rear end thereof. As the resulting reaction, the watercraft obtains a propulsion force. In FIG. 1, reference numeral 126 denotes faring vanes for guiding a water flow behind the impeller 120.

As shown in FIG. 1, a bar-type steering handle 130 is configured to operate in association with a steering nozzle 128 located behind the pump nozzle 127. The steering nozzle 128 is pivotable rightward and leftward around a pivot shaft which is not shown. When the rider rotates the handle 130 clockwise or counterclockwise, the steering nozzle 128 is pivoted in an opposite direction, and thereby the watercraft can be correspondingly turned to any desired direction.

As shown in FIG. 1, a bowl-shaped reverse deflector 129 is mounted to an upper region of the steering nozzle 128 so as to be pivotable downward around a pivot shaft 124 horizontally mounted. The deflector 129 is pivoted downward behind the steering nozzle 128 to direct the water ejected rearward from the steering nozzle 128 forward, so that forward movement of the watercraft switches to rearward movement.

Figure 3:
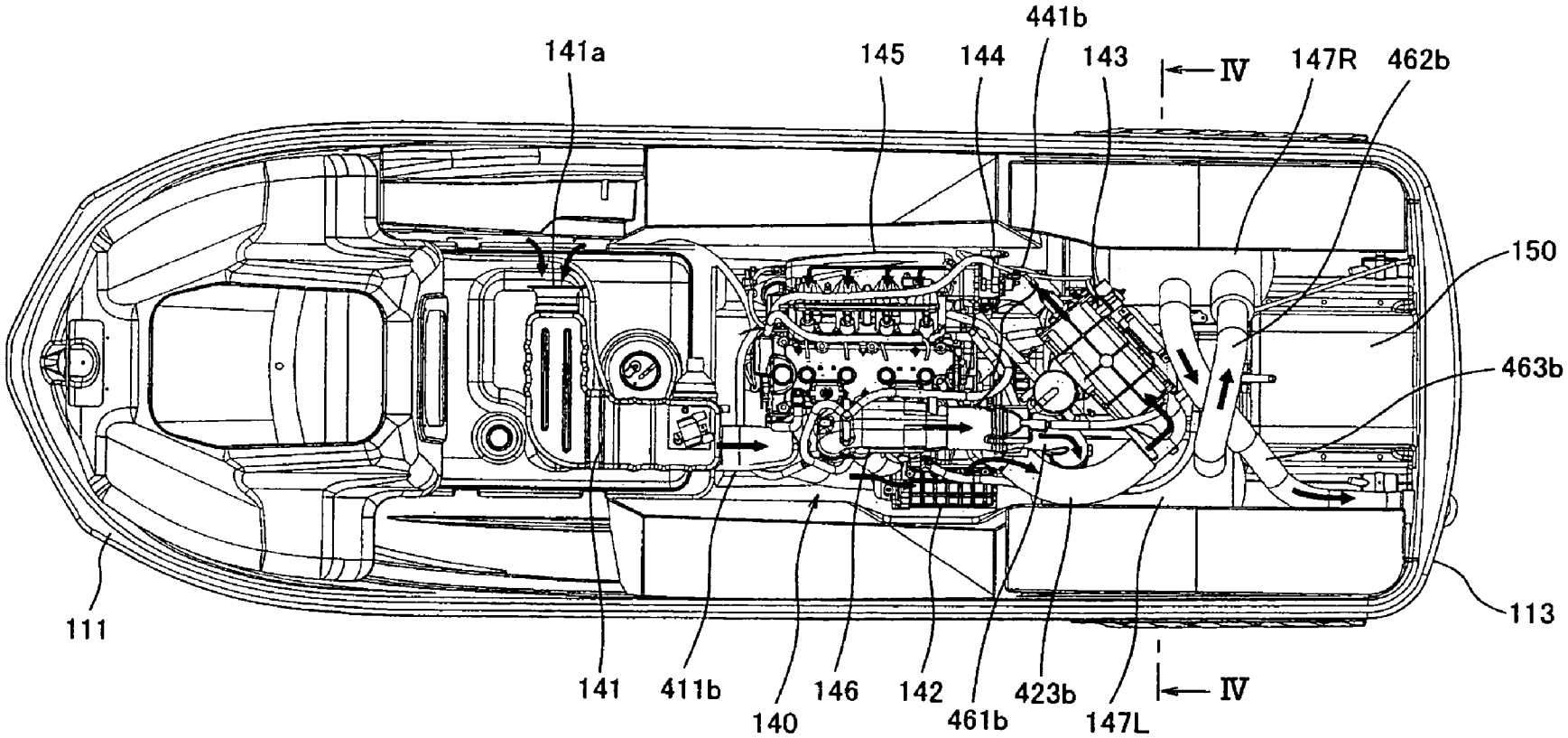
FIG. 3 is a plan view of the air intake system and the air exhausting system of the engine of the personal watercraft of FIG. 1, from which a deck is removed.
Figure 4:
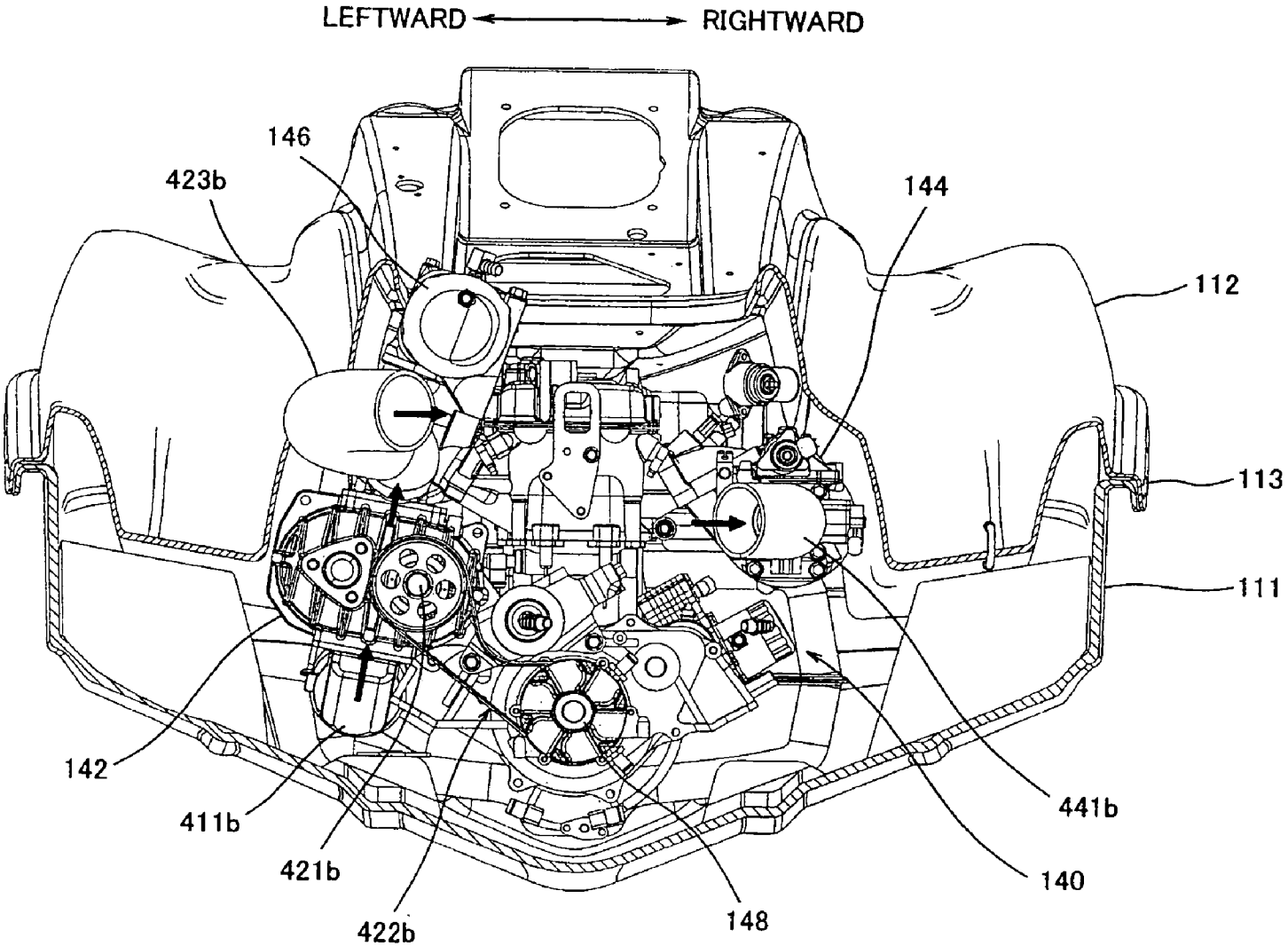
FIG. 4 is a cross-sectional view of the watercraft, taken in the direction of arrows along line IV-IV of FIG. 3.

As shown in FIGS. 2 to 4, an air box (also referred to as an air-intake box) 141 is disposed forward of the engine 140. The air box 141 is of a box form in L-shape as viewed from above and is provided with an air inlet 141*a* that opens on a right side thereof. The air is introduced into the air box 141 through the air inlet 141*a* and the water and trashes are removed from the air through a labyrinth structure (not shown) inside the air box 141. One end of a flexible air-intake pipe 411*b* is coupled to a rear end portion of the air box 141. The air-intake pipe 411*b* extends rearward and a rear end thereof is coupled to an air inlet (see FIGS. 2 and 4) formed on a lower surface of a supercharger 142 which is a supercharging device configured to pressurize the air taken in from outside and supplied to the engine 140.

As the supercharging device, a turbocharger may be used, instead of the supercharger 142.

The supercharger 142 is mounted at an intermediate height section of a rear portion of a left side surface of the engine 140 including a crankcase, a cylinder, and a cylinder head in such a manner that its rear half part protrudes from a rear surface of the engine 140. An exhaust manifold 146 is disposed above the supercharger 142. As shown in FIG. 4, an input shaft 421*b* of the supercharger 142 extends rearward and is coupled to the crankshaft 148 via a belt and pulley mechanism 422*b*. In this construction, when the crankshaft 148 rotates upon the start of the engine 140, the rotation of the crankshaft 148 is transmitted to the input shaft 421*b* of the supercharger 142 via the belt and pulley mechanism 422*b*. The supercharger 142 actuates an internal pump (not shown) built therein according to the rotation of the input shaft 421*b* to compress the air fed from the air box 141 through the air-intake pipe 411*b* and sends to an intercooler 143 (FIG. 3) the compressed air with a relatively high pressure and a high temperature.

One end of an air-intake pipe 423*b* is coupled to an air outlet formed on an upper surface of the supercharger 142. An opposite end of the air-intake pipe 423*b* is coupled to an air inlet (see FIG. 3) formed on a rear end surface of the intercooler 143.

As shown in FIG. 3, the intercooler 143 is of a thin box shape with a thickness direction that is oriented horizontally. The intercooler 143 is disposed behind the engine 140 to be tilted leftward in a rearward direction. The intercooler 143 cools the air that is fed from the supercharger 142 through the air-intake pipe 423*b* and feeds the cooled air to a throttle device (throttle body) 144 through an air-intake pipe 441*b*. The throttle device 144 is configured to control an amount of the intake air supplied to the engine 140. One end of the air-intake pipe 441*b* is coupled to an air outlet which is formed on an end surface of the intercooler 143 to open rightward and forward. An opposite end of the air-intake pipe 441*b* is coupled to be an air inlet of the throttle body 144. The throttle device 144 may be a carburetor, or other component. In such a construction, the air can be guided through a small space efficiently from the supercharger 142 to the engine 140 through the intercooler 143.

The throttle body 144 is positioned adjacent an air inlet of an intake manifold 145. The throttle body 144 controls the amount of air fed from the intercooler 143 according to an operation of a throttle lever (not shown) attached to the handle 130 (FIG. 1) and feeds the air to an intake manifold 145.

The intake manifold 145 extends on an upper region of a right side surface of the engine 140 over substantially the entire length in the longitudinal direction. The intake manifold 145 is configured to distribute the air with the controlled amount that is fed from the throttle device 144 coupled to a rear end portion of the intake manifold 145 and to feed the air to combustion chambers (not shown) of respective cylinders formed in the cylinder block through air-intake ports formed in the cylinder head.

After combustion, an exhaust gas gathers to an exhaust manifold 146 through exhaust ports (not shown) formed on the cylinder head. The exhaust manifold 146 extends on an upper region of a left side surface of the engine 140 over substantially the entire length in the longitudinal direction. One end of a flexible exhaust pipe 461*b* is coupled to a rear end portion of the exhaust manifold 146. An opposite end of the exhaust pipe 461*b* extends rearward and is bent downward and is coupled to a first water muffler 147L mounted on a left side behind the engine 140, i.e., leftward of a bearing case 152 (see FIGS. 5 to 7) described later. The first water muffler 147L is coupled to a second water muffler 147R disposed on a right side behind the engine 140, i.e., rightward of the bearing case 152. The second water muffler 147R is positioned so that its front end is located rearward relative to that of the first water muffler 147L in the longitudinal direction of the body 110.

In this construction, the exhaust gas gathering to the exhaust manifold 146 is delivered to the first water muffler 147L through the exhaust pipe 461*b* and then to the second water muffler 147R through an exhaust pipe 462*b*. Thereafter, the exhaust gas is finally discharged outside the watercraft through an exhaust pipe 463*b* extending from the second water muffler 147R.

With reference to FIGS. 1, 5, 6 and 7, the arrangement and structure of the intercooler 143 will be described. As shown in FIG. 1, the water jet pump P is accommodated in the pump room 150. As shown in FIGS. 1, 5, 6, and 7, the pump room 150 is formed integrally with the hull 111 by upwardly recessing a portion of the hull in a generally rectangular shape at a location inward a transom 154. A forward end of the pump room may be formed by a rear end portion of a center region in a width direction of a bottom surface of the hull 111. The water intake passage 123 is formed on a front surface of the pump room 150 to extend forward. The bearing case 152 of a hollow box shape is disposed above the water intake passage 123 and is configured to support the propeller shaft 119 such that the propeller shaft 119 is rotatable. The bearing case 152 is provided on a front surface thereof with a bearing 149 having a sealed structure, and is configured to support a front portion of the propeller shaft 119 by the bearing 149 such that the propeller shaft 119 is rotatable. To be more specific, as shown in FIG. 1, the bearing case 152 has a width substantially equal to that of the water intake 122 of the water jet pump P and extends above the water intake passage 123 from a front portion of the pump room 150 to a region near a front end of the water intake 122. Also, as shown in FIG. 1, the bearing case 152 has an open bottom and an open rear end, and is fastened to an inner surface of the hull 111 on an open end surface side thereof by a fastening means (adhesive in this embodiment).

Figure 5:
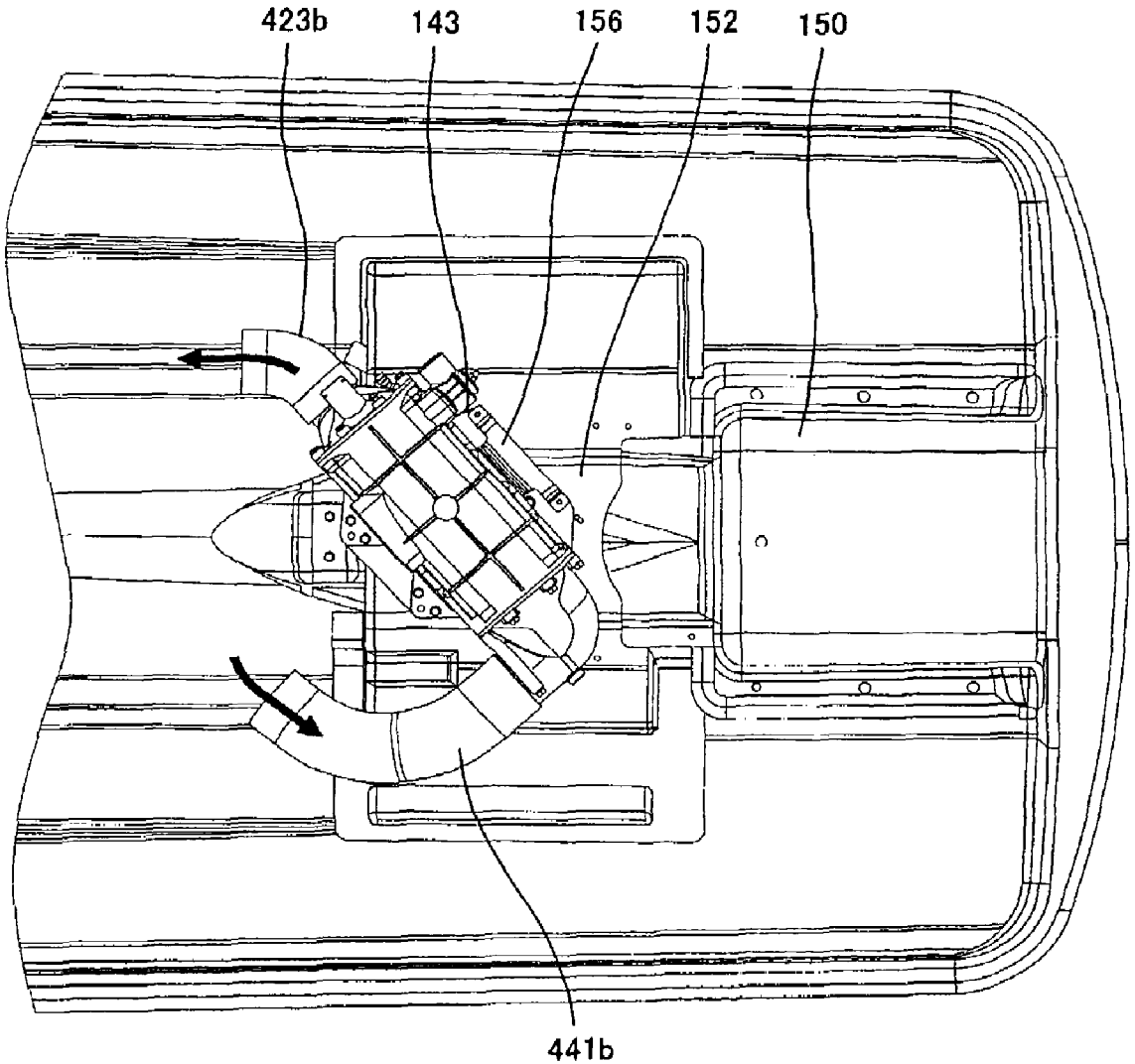
FIG. 5 is a plan view of an internal part of the hull, showing arrangement and structure of an intercooler of FIG. 3.
Figure 6:
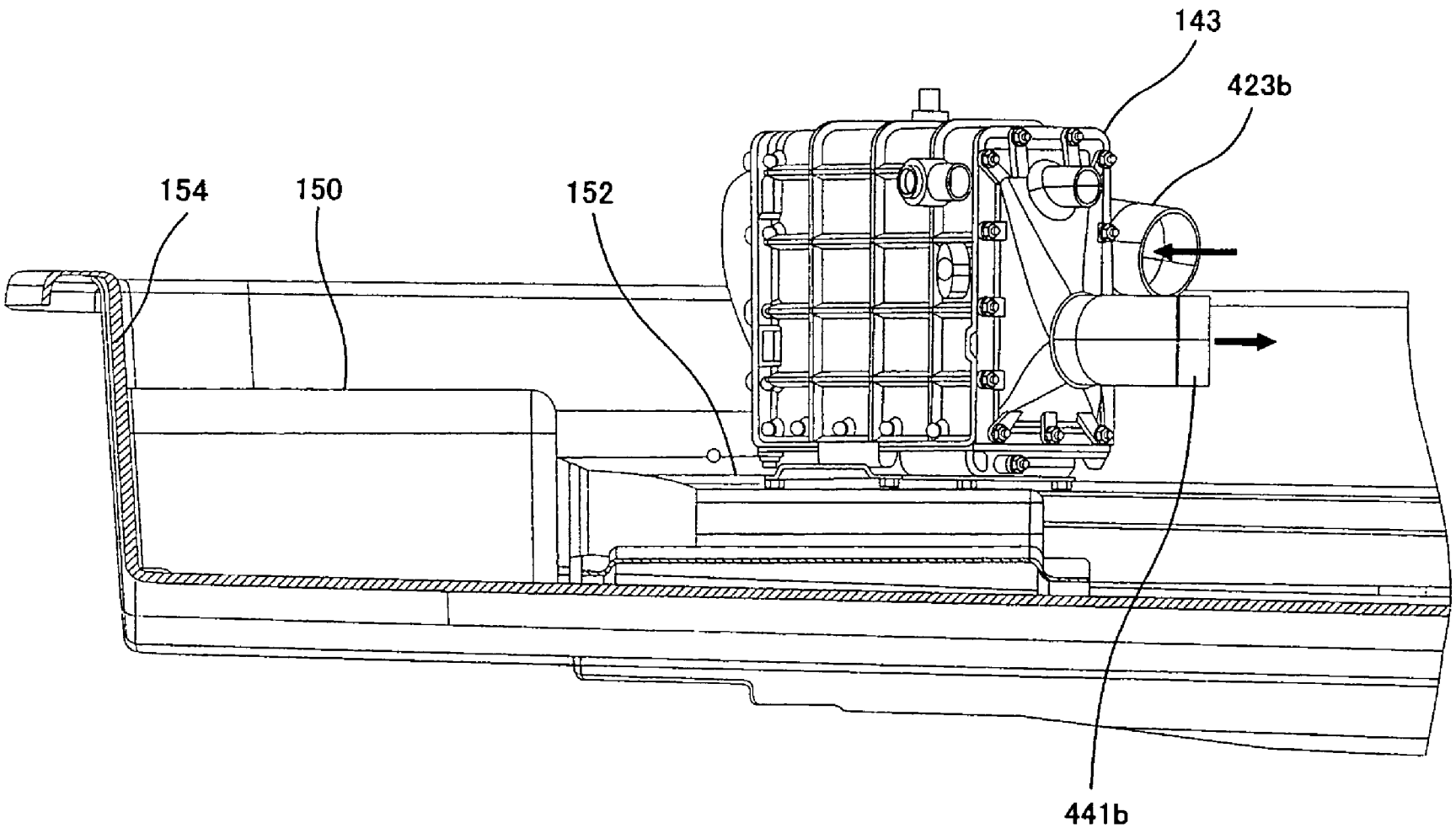
FIG. 6 is a right side view showing the arrangement and construction of the intercooler of FIG. 3.
Figure 7:
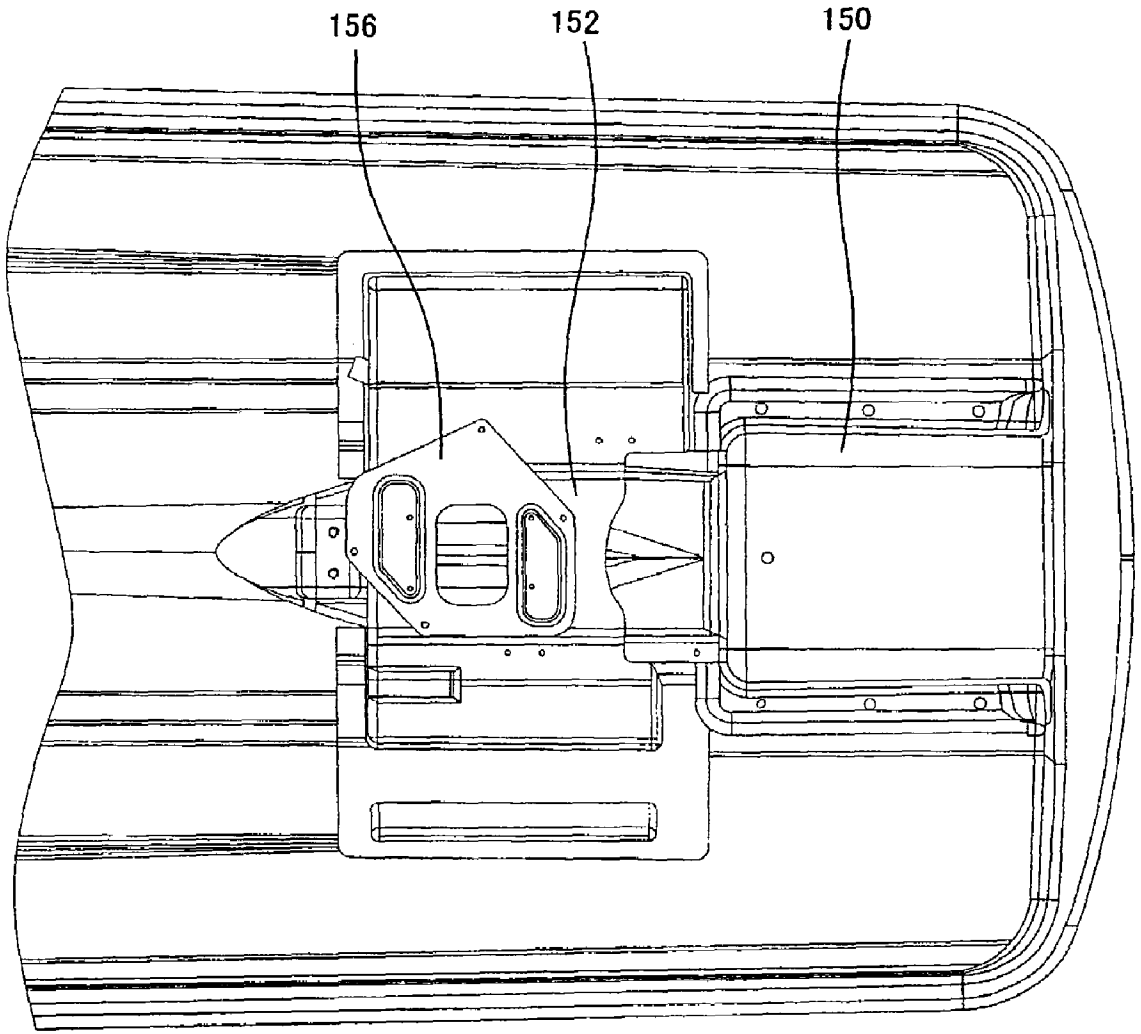
FIG. 7 is a plan view of the internal part of the hull, showing a mounting base plate of the inter cooler of FIG. 5.

Turning to FIGS. 5 to 7, a base plate 156 is fastened to an upper surface of the bearing case 152. The base plate 156 is configured to hold the intercooler 143 mounted thereon such that the intercooler 143 is tilted and protrudes from the bearing case 152 in a width direction. Also, the intercooler 143 is disposed such that its front portion protrudes from a front surface of the bearing case 152. As shown in FIG. 3, the intercooler 143 is disposed such that its front portion is positioned in a forward space of the second water muffler 147R located rearward relative to the first water muffler 147L. In this manner, the forward space of the second water muffler 147R is efficiently utilized, and interference of the exhaust pipes 462*b* and 463*b* with a rear portion of the intercooler 143 can be easily avoided.

Figure 8:
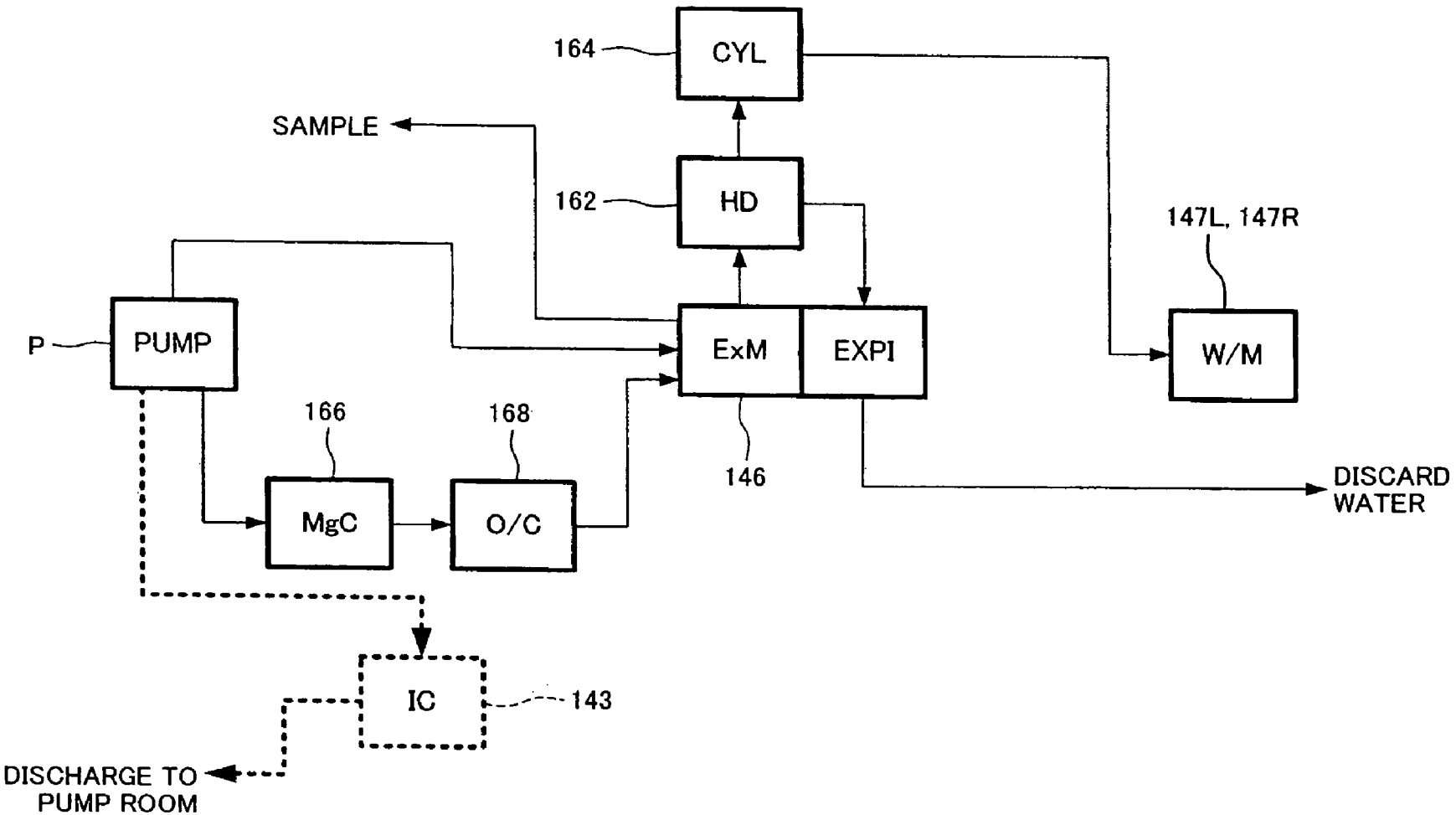
FIG. 8 is a block diagram showing a construction of a water cooling system of the personal watercraft of FIG. 1.

With reference to FIG. 8, a water cooling system of an engine unit including the engine 140 and the intercooler 143 will be described. In this embodiment, the engine unit employs an open-loop cooling system configured to take in water from outside for use as cooling water for cooling engine components. The cooling water is fed to the engine unit through independent two water flow passages by utilizing a pressure inside the water jet pump P.

The first water flow passage includes a path extending directly from the water jet pump P to the exhaust manifold 146 (see FIG. 2) and a path extending from the water jet pump P to a magnet cover 166 of the engine unit 140 and an oil cooler 168 and then to the exhaust manifold 146. In the first water flow passage, the cooling water is fed from the exhaust manifold 146 to the cylinder head 162 and the cylinder 164, and then to the first and second water mufflers 147L and 147R, and is thereafter discharged outside the watercraft.

A part of the cooling water fed to the cylinder head 162 is guided to an exhaust pipe (EXPI) and discharged outside the watercraft as discarded water. In contrast, water is sampled from the exhaust manifold 146 to check whether or not the cooling water system is operating correctly, and is discharged after the check.

In the second passage, as indicated by a broken line in FIG. 8, the cooling water is fed from the water jet pump P directly to the intercooler 143 and is thereafter discharged to the pump room 150.

As described above, since the intercooler 143 is positioned in close proximity to the water jet pump P which is a cooling water source, a pipe coupling the intercooler 143 to the water jet pump P can be made short, increasing cooling efficiency. Furthermore, since the cooling water passage of the intercooler 143 is independent of the cooling water passage for other part of the engine 140, the intercooler 143 can be cooled independently, improving flexibility of piping design. As a result, cooling efficiency is further increased.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

an engine;

a water jet pump configured to be driven by the engine to propel a body of the watercraft;

a propeller shaft configured to couple a rear end portion of a crankshaft of the engine to a pump shaft of the water jet pump to transmit an output power of the engine to the water jet pump;

a bearing case configured to support a front portion of the propeller shaft such that the propeller shaft is rotatable;

a supercharging device configured to pressurize air taken in from outside and supplied to the engine;

an intercooler configured to cool the air pressurized and compressed by the supercharging device; and a pump room which is formed on a bottom surface of a rear end portion of the body and is configured to accommodate the water jet pump therein;

wherein the intercooler is positioned forward of the pump room and behind the engine and is mounted to an upper surface of the bearing case.

2. The personal watercraft according to clam 1, wherein the intercooler has an open cooling system configured to take in water pressurized inside the water jet pump for use as cooling water and to discharge the cooling water that has cooled the intercooler outside the body of the watercraft; and wherein the intercooler has a cooling water passage independent of a cooling water passage of the engine.

3. The personal watercraft according to claim 1, wherein the bearing case is provided inside the body such that the bearing case is located forward of and adjacent the pump room and mounted on an upper region of a water passage through which water taken in from outside is fed to an inlet of the water jet pump.

4. The personal watercraft according to claim 3, further comprising:

a pair of first and second water mufflers which are arranged on right and left sides of the bearing case and are positioned so that a front end of the second water muffler is located rearward relative to a front end of the first water muffler in a longitudinal direction of the body, the first and second water mufflers being coupled to each other at rear portions thereof by an exhaust pipe;

wherein a front end portion of the intercooler is disposed in a forward space of the second water muffler.

* * * * *